US005670182A

United States Patent [19]

Mower

[11] Patent Number: 5,670,182

[45] Date of Patent: Sep. 23, 1997

[54] MASTIC APPLICATOR

[75] Inventor: Morris F. Mower, Riverton, Utah

[73] Assignee: Axia Incorporated, Oak Brook, Ill.

[21] Appl. No.: 389,142

[22] Filed: Feb. 15, 1995

[51] Int. Cl.[6] ..... E04F 21/08; B05C 5/02

[52] U.S. Cl. ..... 425/87; 401/5; 401/48; 425/12; 425/87; 425/90; 425/94; 425/458

[58] Field of Search ..... 425/87, 458, 90, 425/94, 12; 118/207, 208, DIG. 17; 401/1, 48

[56] References Cited

U.S. PATENT DOCUMENTS

| | | | |
|---|---|---|---|
| 2,824,442 | 2/1958 | Ames | 425/87 |
| 2,984,857 | 5/1961 | Ames | 425/87 |
| 3,888,611 | 6/1975 | Ames | 425/87 |
| 4,907,955 | 3/1990 | Snipes | 425/87 |
| 5,069,610 | 12/1991 | Milburn | 425/87 |
| 5,137,386 | 8/1992 | Mower | 401/48 |

*Primary Examiner*—Jan H. Silbaugh
*Assistant Examiner*—Suzanne E. Mason
*Attorney, Agent, or Firm*—Laff, Whitesel, Conte & Saret, Ltd.

[57] ABSTRACT

A mastic applicator includes a guide mechanism mounted to the applicator so that the applicator is maintained in alignment with outside corners during application of mastic. The guide mechanism includes a pair of corner guides which have guide surfaces aligned with the side edges of the outlet from which the mastic flows. The corner guides are spring mounted so that they retract when they are not positioned at a corner, thereby allowing the applicator to be used on both sides of a corner, as well as on flat joints, without adjustment to the applicator. The mechanism also includes a pair of stub guides located on the applicator surface. The stub guides can be slid into position to engage opposite outside corners of a stub wall for effective application of mastic between the outside corners.

17 Claims, 2 Drawing Sheets

MASTIC APPLICATOR

This invention relates to tools used during the installation or repair of wall board, drywall, or other surfaces, and more particularly, to an apparatus for applying joint compound or mastic to such surfaces.

BACKGROUND

Wall board or drywall panels are generally erected with abutting edges. The gap between the abutting edges of such adjacent panels, sometimes referred to as a wall joint, generally must be taped and filled with joint compound or mastic. Often, several coats of mastic are applied, with the last being a finishing coat. Thus, construction with drywall may involve numerous coats of mastic applied to numerous wall joints.

When two adjacent panels lie on the same surface, their abutting edges form a flat wall joint. Mastic applicators for filling such flat wall joints more quickly have been developed, such as those disclosed in U.S. Pat. Nos. 2,824,442; 2,984,857; and 3,888,611 to R. G. Ames. These applicators, sometimes referred to as "Ames boxes," generally include a housing in which a quantity of mastic can be stored, a moveable plate which can be pushed against the quantity of mastic, and an outlet through which the mastic flows to the selected surface. The flow of mastic from the housing can often be regulated by the drywall finisher as the outlet is passed over the surface to receive the mastic.

These mastic applicators, however, are ill-suited for use in finishing wall joints occurring at outside corners. For example, the applicator often cannot be accurately aligned with the corner, which causes excess mastic, sometimes referred to as "drool," to exit from the mastic tool past the edge of the corner.

In addition, corner joints are often reinforced by using corner trim or corner beads, which are strips of metal or plastic which extend along one or both sides of the corner. The corner bead may be slightly raised from the wall surfaces right at the edge of the corner, which again, often makes it difficult to use mastic applicators for flat joints in the presence of corner beads on the wall surface.

There has also been little done to ease application of mastic to stub walls. A stub wall generally refers to a wall with a relatively short span, generally equal to the width of a piece of lumber having width and depth dimensions of about two inches by four inches ("2×4") plus the overlying drywall on either side of the 2×4. Stub walls may occur at the exposed end of a partition wall between the two opposing surfaces of the partition wall.

The stub wall thus has two opposite, outside corners, to which applying mastic with conventional applicators is generally difficult as described above. In addition, when the span or width of the stub wall is less than the width of the mastic applicator, mastic from conventional applicators will undesirably flow out at a point far removed from one or both of the stub wall sides.

Because of the problems associated with using flat-joint mastic applicators on outside corners and stub walls, drywall finishers often forego the convenience of using applicators with housings which store a quantity of mastic for regulated application to the surface. Instead, finishers have generally had to use joint compound knives with either a single straight edge or with two surfaces at right angles to each other. Mastic is scooped onto these knives from conventional mud pans or trays and then applied to the corner joint.

Since the finisher must repeatedly add mastic to such a knife, as well as scrape off the excess between application strokes, applying mastic to outside corners is much slower than applying it to flat joints by means of mastic applicators with housings. In addition, use of these corner knives requires far more strokes to achieve the desired smoothness of the coat than using mastic applicators with housings, oftentimes prematurely tiring the worker. Coats of mastic applied with knives are not as uniform, aesthetically pleasing, or consistent as those using mastic applicators with housings. It is also inconvenient to carry a separate set of tools at a site just for applying drywall to outside corners.

One attempt to improve application of mastic to outside corners, disclosed in Milburn U.S. Pat. No. 5,069,610, involves attaching sliding corner guard members to the sides of conventional flat-joint mastic applicators. The corner guard members have flat end portions which can be brought against the corner to be finished to inhibit the applicator being moved away from the corner to receive the mastic.

The attempted solution of Milburn, however, has various drawbacks and disadvantages. For example, when the applicator is positioned with the corner guard against the corner, mastic cannot be applied effectively at the corner bead, generally causing a gap to form between the corner and the beginning of the coat of mastic. In addition, the corner guards must be manually slid into and out of position, a process which can become especially cumbersome when the user needs to rapidly alternate between applying mastic to one side of a corner and another, or between flat joints and corner joints. The disclosed structure of Milburn also does not address the difficulties in applying mastic to stub walls.

Accordingly, there is a need for a mastic applicator which allows outside corners to be efficiently and effectively coated with mastic or drywall compound.

SUMMARY

Accordingly, an object of this invention is to provide a mastic applicator which can function effectively both at corner joints and at flat joints.

Another object is to provide a mastic applicator for stub walls.

Still another object is to have the mastic applicator adjustable to accommodate stub walls of varying widths.

According to the present invention, the foregoing and other objects and advantages are attained by a drywall apparatus which includes a mastic applicator, the mastic applicator having an applicator surface with an outlet from which the mastic flows onto an area to receive the mastic. The applicator has portions which guide one or both of the side edges of the outlet along an outside corner of the area to receive the mastic. These guide portions include corner guides which are biased outward from the applicator surface and retractable so as to be generally coplanar with the applicator surface.

According to another aspect of the invention, the applicator includes stub guides laterally spaced from each other so that a stub wall fits between the stub guides. The stub guides can be laterally adjusted to fit up against both outside corners of the stub wall simultaneously. In addition, the position of the side edges of the outlet can be varied to make the outlet wider or narrower, depending on the width of the stub wall to receive the mastic.

Still other objects, advantages, and novel aspects of the present invention will become apparent in the detailed description of the invention that follows, in which the preferred embodiment of the invention is shown by way of illustration of the best mode contemplated for carrying out the invention, and by reference to the attached drawing in which:

DESCRIPTION

Figure 1:
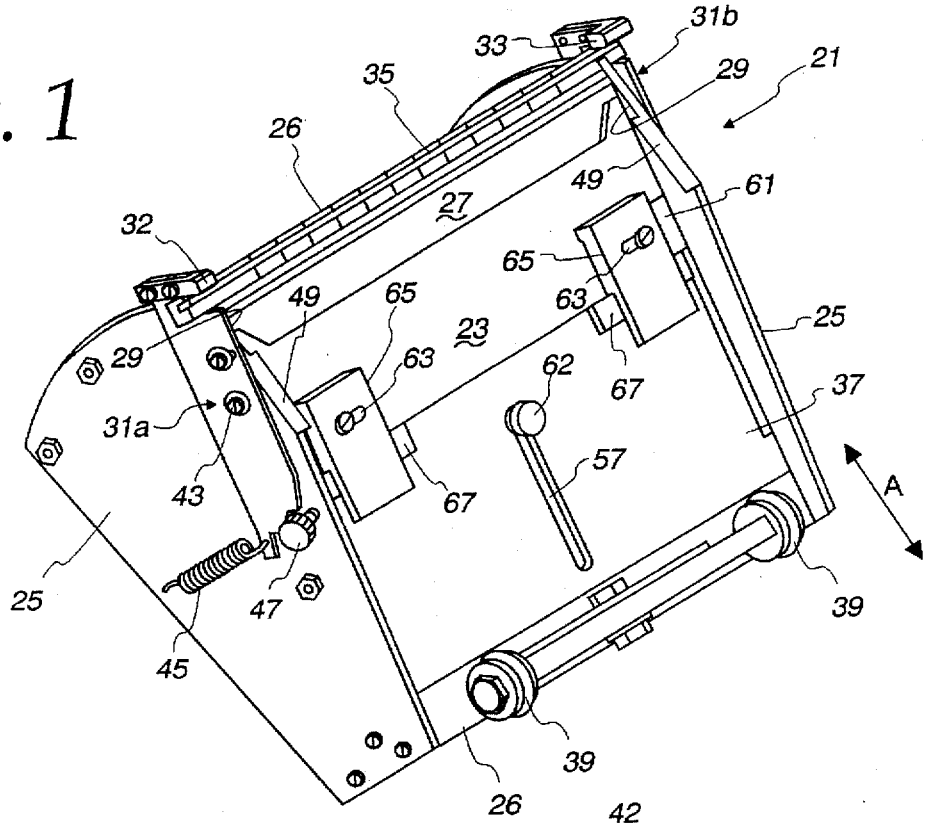
FIG. 1 is a perspective view of a mastic applicator embodying the present invention.
Figure 2:
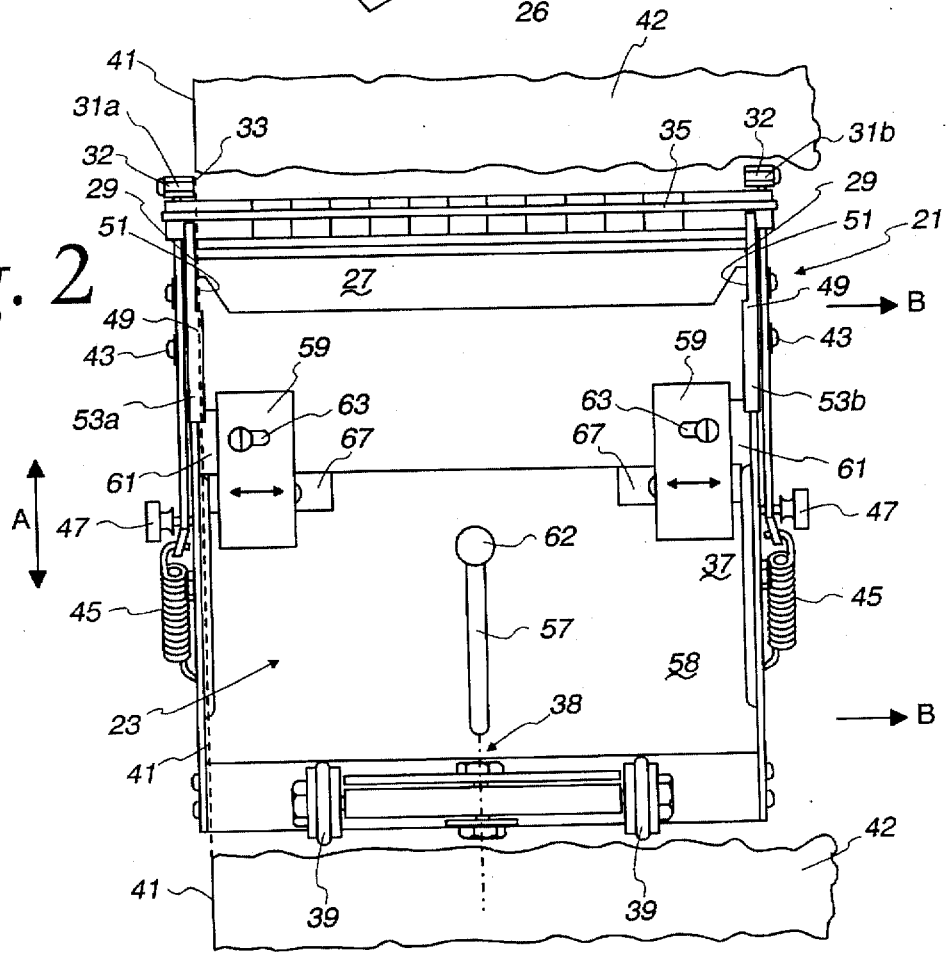
FIG. 2 is a bottom plan view of the applicator of FIG. 1 shown positioned at an outside corner (partially cut away)

Referring to FIGS. 1 and 2, an apparatus according to the present invention includes a mastic applicator 21 adapted to be mounted to a conventional handle or wand. The mastic applicator 21 includes an applicator surface 23. Front and back walls 26 and side walls 25 extend generally perpendicularly from the perimeter of the applicator surface 23 to form a housing in which mastic can be stored.

The applicator surface 23 is generally planar and includes a blade 35 located at the top edge of the applicator surface 23. An outlet 27 for the mastic is located proximate to the blade 35. A stub-wall assembly 37 is mounted to the applicator surface and can be slid toward and away from the outlet 27 as discussed in more detail below. A pair of laterally-spaced rollers 39 are toggle-mounted at the bottom edge of the applicator surface 23.

In use, the applicator surface 23 is brought against the surface to receive the mastic. The mastic is pressed out of the outlet 27 in the applicator surface 23 by a conventional press plate (not shown) positioned generally behind the applicator surface 23. As the mastic is being pressed out, the applicator 21 is generally moved in the directions indicated by the arrow A to apply a quantity of mastic to the surface. The rollers 39 are designed to contact the surface to aid movement of the applicator 21 in relation to the surface.

Referring now to FIGS. 1 and 2, the outlet 27 extends transversely across the applicator surface and has side edges 29 coinciding substantially with the edge of the applicator surface 23. A corner guide 31*a* or 31*b* is pivotally mounted to each of the side walls 25 and near the side edges 29 of the outlet 27.

Figure 4:
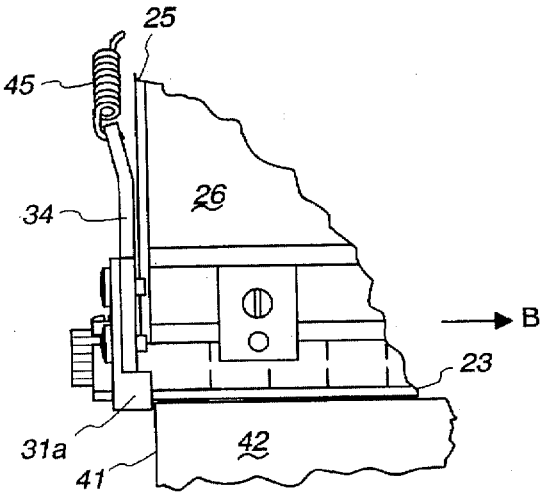
FIG. 4 is an enlarged top view of a portion of the applicator embodying the present invention and showing one of the corner guides engaged at an outside corner.

The applicator 21 is shown in FIG. 2 positioned over an area 42 adjacent to an outside corner 41. The outside corner 41 is shown in solid lines and, where broken away, in dotted lines. Each of the corner guides 31*a* or 31*b* has a guide surface 33 which can be positioned to extend slightly out of the general plane of the applicator surface 23 as best seen in FIGS. 1 and 4. In this way, when, as seen in FIG. 2, the applicator is positioned over an area 42 adjacent to the outside corner 41, the corner guide 31*a* or 31*b* extends over the edge of the surface 42 (FIG. 4) and engages the outside corner 41. The corner guides also include rounded surface 32 generally parallel to the applicator surface 23 and extending transversely from the guide surfaces 33.

When the corner guide 31*a* or 31*b* has engaged the outside corner 41, the applicator 21 is inhibited from moving in the direction of arrow B. In effect, then, when the applicator 21 is moved in the direction of arrow A, it is guided along, or maintained in alignment with, the outside corner 41.

It is important that the corner guides 31*a* or 31*b* have the guide surfaces 33 longitudinally aligned with at least a portion of the side edge 29. In this way, when the corner guides 31*a* or 31*b* abut the outside corner 41 to guide the applicator 21, the mastic which flows out at the side edge 29 is deposited right at the edge of the corner or at the corner bead, if so provided. No gap in the mastic coat occurs because there is no gap between the edge of the outside corner 41 and the side edge 29 of the outlet 27.

Figure 5:
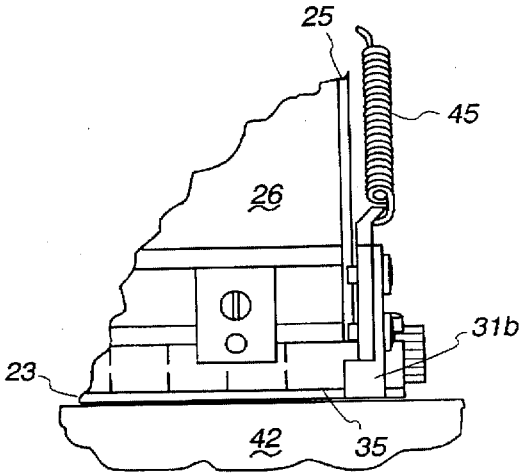
FIG. 5 is an enlarged top view of a portion of the applicator embodying the present invention and showing one of the corner guides retracted.

As best seen in FIGS. 1, 4, and 5, the corner guides 31*a* or 31*b* pivot around screwpoint 43 and are biased to extend from the applicator surface 23 by cylindrical springs 45. One end of the springs 45 is fixed to the sides 25 (FIG. 1) and the opposite spring end is attached to the end of the corner guides opposite the end having the guide surfaces 33. The tension of the springs 45 is sufficiently large so that the corner guide 31*a* remains extended as it travels against the corner 41 (FIG. 4), but sufficiently small so that the corner guide 31*b*, which is not positioned over the edge of the corner 41, retracts under normal operating pressure when the applicator contacts the area 42 (FIG. 5) and is thereby substantially coplanar with the applicator surface 23. When applying the mastic at the outside corner 41, then, One of the corner guides 31*a* or 31*b* will be retracted and the other will be extended, depending on which side of the corner 41 the mastic applicator is being applied to.

In addition, because both of the corner guides 31*a* or 31*b* are retractable, the applicator 21 may be used on flat joints, in which case the rounded tips 32 would contact the wall and both the corner guides 31*a* or 31*b* would retract. From the foregoing, it is seen that a drywall finisher may switch from one side of a corner to the other, or from corner joints to flat joints, without needing to switch tools and without needing to make any adjustment to the corner guides 31*a* or 31*b* or to the mastic applicator 21 he or she is holding.

The corner guides 31*a* or 31*b* are also provided with locking screws 47. The corner guides can be moved to a retracted position and locked by tightening the screws 47 to abut corresponding portions of the corner guides 31*a* or 31*b*.

As best seen in FIG. 2, the applicator surface includes a pair of side skids 49 mounted at the opposite side edges of the applicator surface 31 and adjacent to the outlet 27. The skids 49 have notched portions which define skid edges 51 aligned with the side edges 29 of the outlet. The skids 49 also have skid surfaces 53*a* or 58*b* which are substantially coplanar with the applicator surface 23. When the applicator 21 is positioned as shown in FIG. 2, the skid surface 53*a* can be brought into contact with the raised portion of the corner bead, if one is present, instead of the blade 35 rubbing against the corner bead. The skid surface 53*a* thus can be used to avoid wear and tear on portions of the blade 35.

Still referring to FIG. 2, the rollers 39 are toggle mounted about an axis indicated at 38. In this way, if one of the rollers 39 encounters a raised portion or other irregularity as it moves over the area 42, the applicator surface is not generally raised away because of the irregularity, thereby allowing the mastic to be applied smoothly over the irregularity. This toggle-feature may be particularly important when the roller 39 closer to the corner 41 rides over the raised surface of a corner bead.

As best seen in FIGS. 4 and 5, each of the corner guides 31*a* or 31*b* include an elongated member and an L-shaped member 34 mounted at the end of the elongated member which extends from the applicator surface 23. The L-shaped members 34 extend inward from the sides 25 and terminate in alignment with the side edges 29 (FIG. 2). These inner surfaces in this embodiment form the guide surfaces 33 for the corner guides 31*a* or 31*b*.

Figure 3:
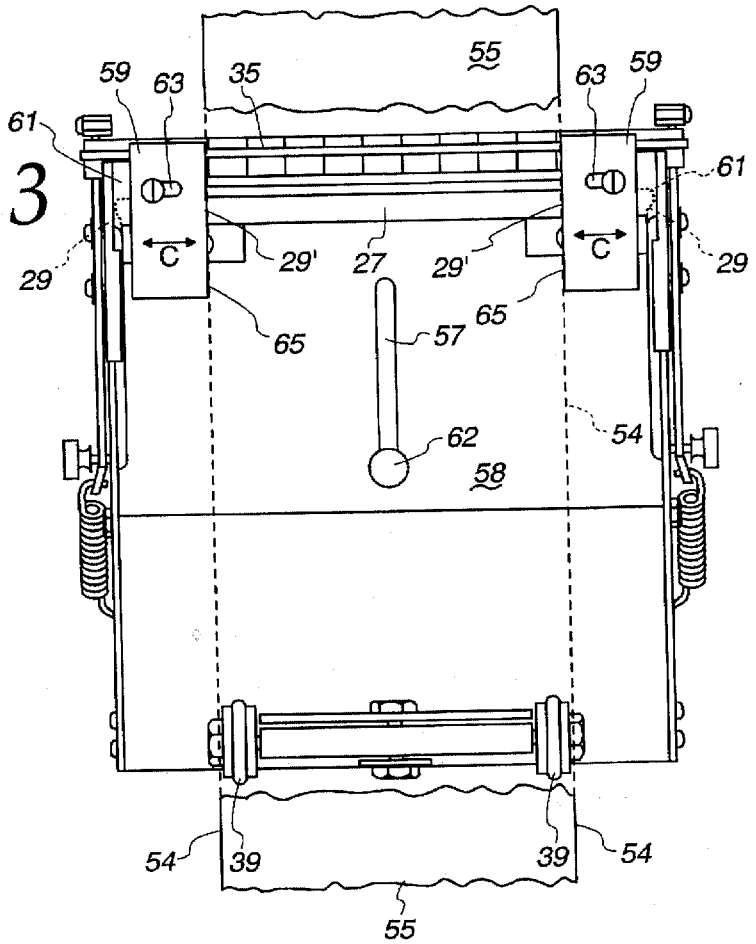
FIG. 3 is a bottom plan view of the applicator of FIG. 1 shown positioned at a stub wall.

The applicator 21 includes a stub-wall assembly 37 shown in its disengaged position in FIG. 2 and in its engaged position in FIG. 3 when the applicator is being used on a stub wall 55. As seen in FIG. 2, the applicator surface 23 generally rests on the area to receive mastic at the rollers 39 and either the blade 35 or side skids 49, thereby forming a plane of contact including those contact points. The stub-wall assembly 37 is constructed to be generally planar and positionable against the applicator surface so as to be out of the plane of contact with the area to receive mastic when the assembly is positioned at the bottom edge of the applicator surface 23 as shown in FIG. 2. In this position, then, the assembly 37 does not affect operation of the applicator 21.

The assembly 37 is slidably mounted to the applicator through slot 57. Set screw 62 can be used to fix the assembly in place relative to the applicator surface 23. The assembly includes a base plate 58 and a pair of laterally spaced stub guides 59 which extend from the top edge of the base plate 58. The stub guides 59 are mounted to flange portions 61 which extend from the top edge of the base plate 58 underneath the stub guides 59.

The stub guides are laterally adjustable because they are mounted to the portions 61 by a pin, in this case a screw 62, received in a slot 63 which extends laterally through the stub guides 59. The stub guides 59 include inner guide portions 65 (FIG. 1) which extend slightly from the plane of the base plate 58.

The assembly 37 is slid to the top edge as shown in FIG. 3 for use on a stub wall 55. The stub wall 55 is generally narrower than the applicator 21 and includes opposite outside corners 54 shown partially cut away to reveal the applicator surface 23. The stub guides 59 can be laterally adjusted in the direction of arrow C so that each of the inner guide portions 65 engage a corresponding outside corner 54. The applicator 21 is thus guided along the two opposite corners 54 of the stub wall 55. The rollers 39 are laterally spaced a distance no greater than the narrowest adjustment permitted for the stub guides 59. In this way, the rollers 39 contact the surface of the stub wall 55.

When the assembly 37 is engaged as shown in FIG. 3, side portions of the outlet 27 become covered by the portions 61 of the assembly 37, as well as by parts of the stub guides 59 which extend inward from the portions 61. The position of the side edges 29' thus is shifted or varied inward from that of side edges 29 (shown in dotted lines on FIG. 3), thereby narrowing the width of the outlet 27 to correspond to the width of the stub wall 55. Mastic thus does not exit the outlet 27 at locations where there is no underlying area to receive the mastic.

The assembly 37 includes stub skids 67 near the stub guides 59 and extending transversely along the top edge of the base plate 58. The stub skids 67 extend generally parallel to but slightly above the plane of the base plate as shown in FIG. 1. When the assembly 37 is positioned as shown in FIG. 3, the geometry of the applicator surface 23 allows it to contact the stub wall 55 at the rollers 39 and the stub skids 67 without substantial contact with the blade 35. When the corners 54 include a rigid raised portion, such as with a metal bead, the ability to avoid contact between the blade 35 and the corners 54 saves unnecessary wear and tear on the blade 35.

From the foregoing description, the applicator 21 embodying the present invention is used by placing and moving the applicator surface 23 over an area, such as a wall joint, to receive mastic. When the wall joint is a flat joint, both of the corner guides **31*a* or 31*b* will retract upon contact with the wall surfaces on either side of the flat joint. Alternately, the corner guides 31*a* or 31*b* can be locked by set screws 43 in a retracted position. The assembly 37** is preferably locked in its lower position and is thereby disengaged from significant contact with the flat joint to receive the mastic.

As best seen in FIG. 2, when the applicator 21 is applied at an area adjacent to an outside corner, one of the corner guides **31*a* or 31*b* engages the corner while the other corner guide, when in contact with the surface receiving the mastic, retracts to be generally coplanar with the applicator surface 23. Again, the assembly 37** is preferably locked in its lower, disengaged position.

Referring now to FIG. 3, the applicator 21 is applied to stub walls by positioning the assembly 37 toward the top of the applicator 21. If necessary, the stub guides 59 are laterally adjusted to engaged the opposite corners 54 of the stub wall. The portions 61 of the assembly 37, as well as inner portions of the stub guides 59, cover the sides of the outlet 27 to keep unnecessary mastic from exiting where there is no stub wall to receive it.

The assembly 37, as well as the corner guides **31*a* or 31*b*, are preferably machined metal parts, although polymeric material may also be used in certain applications. The lateral spacing between the stub guides 59 can be adjusted between about 4 ⅝" to about 4 ⅞", which, at the low end of the range, will accommodate the longer side of a standard 2×4 with two panels of half-inch drywall on either side and two, one-sixteenth inch corner beads at each of the corners 54; and, at the high end of the range, will accommodate the same configuration using commercial thickness drywall of ⅝". Of course alternative lateral adjustments for the stub guides 59** could be provided for stub walls and drywall panels of varying thicknesses.

The width of the outlet 27 is slightly wider than outlets in traditional mastic applicators so that mastic exits closer to the side walls 25 of the housing and in alignment with the guide surfaces 33.

The applicator 21 according to the present invention may optionally be equipped with means for adjusting the blade 35 so that the thickness of applied mastic coat can be varied. Such adjusting means may comprise a crown adjustment (not shown) with multiple cam surfaces which vary the pressure on the blade 35 and thereby allow more or less of the mastic to be deposited on the desired surface. The guides 31, 59 are positioned in relation to the applicator surface 23 and the blade 35 so that the guides function as described above irrespective of how the blade 35 may be adjusted.

In addition to the advantages apparent from the above description, the applicator of the present invention has various additional advantages over the prior art. For example, there is no need for a separate set of outside corner tools to be purchased for and brought to a job. Application of mastic to both flat joints and outside corner joints can be accomplished by one tool.

The present invention thus has the advantage of allowing drywall finishing to be accomplished more quickly and with less fatigue on those performing the jobs than if prior art knives or other tools were to be used.

Outside corners with and without corner beads can receive mastic uniformly and without gaps between the mastic and the edge of the corner.

A further advantage is the ability to vary the width of the outlet so that opposing outside corners, such as on stub walls, can be effectively coated with mastic.

While the present invention has been described with reference to a preferred embodiment thereof, illustrated in the accompanying drawings, various changes and modifications can be made by those skilled in the art without departing from the spirit and scope of the present invention; therefore, the appended claims are to be construed to cover equivalent structures.

What is claimed is:

1. A mastic applicator comprising:

a housing having an applicator surface;

a mastic outlet located on the applicator surface through which the mastic is applied, the outlet having opposite side edges;

a pair of corner guides mounted near the side edges, the corner guides being spring biased in a first position extended from the applicator surface to engage a corner of a surface to receive mastic, the corner guides being pivotally mounted to the sides of the housing and retracting to a second position coplanar with the applicator surface in response to placement of the guides against the surface to receive mastic, each of the corner guides having guide surfaces aligned with the side edges and extending generally transversely from the applicator surface, so that when one of the guide surfaces engages the corner, mastic flowing from the corresponding side edge is deposited at the corner without any gap between the corner and the mastic; and a pair of stub guides mounted to the applicator surface, the stub guides being laterally spaced from each other.

2. The applicator of claim 1 further comprising a pair of side skids mounted adjacent the side edges, the side skids having skid edges aligned with the side edges and skid surfaces positionable against a surface to receive the mastic.

3. The applicator of claim 1, wherein the mastic outlet has elongated edges extending between the side edges substantially across the width of the housing, the stub guides being mounted to the applicator surface and slideable transversely to the elongated edges of the mastic outlet, the stub guides being slideable between a first position away from and not obstructing the mastic outlet and a second position to cover and obstruct a portion of the mastic outlet.

4. The applicator of claim 3, wherein the applicator surface includes contact points defining a plane of contact when the applicator surface is against the surface to receive mastic, a flat base plate mounted on said housing adjacent said applicator surface, wherein the stub guides are mounted on said flat base plate to form a stub guide assembly, the stub guide assembly having stub skids disposed thereon, wherein the first position of the stub guides locates the stub guide assembly above a contact with the dry wall surface that is to receive the mastic, whereby the stub guide assembly does not affect an application of mastic to the surface that receives the mastic, and wherein the second position of the stub guides locates the stub skids in a position for making contact that engages said corner surface.

5. The applicator of claim 1, further comprising means for locking the corner guides in the retracted position.

6. The applicator of claim 1, wherein the corner guides include rounded faces extending transversely from the guide surfaces and generally in a plane parallel with the applicator surface.

7. The applicator of claim 1, wherein the stub guides are adjustable in relation to each other to vary the distance between the stub guides, the stub guides having portions positionable to cover the side edges of the mastic outlet.

8. The applicator of claim 7, wherein the stub guides have stub skids adapted to contact the surface to receive the mastic.

9. The applicator of claim 7 further comprising means for fixing the position of the stub guides.

10. A mastic applicator for a surface having an outside corner comprising:

a housing with an applicator surface and an outlet in the applicator surface through which the mastic flows onto a surface to receive the mastic, the outlet having opposite side edges; and means for guiding one of the side edges of the outlet along, and in alignment with, the outside corner of the surface to receive the mastic;

the guiding means comprising corner guides spring biased in a first position extended from the applicator surface to engage the outside corner, the corner guides being pivotally mounted to the sides of the housing and retracting to a second position coplanar with the applicator surface in response to placement of the guides against the surface to receive mastic.

11. The applicator of claim 10 further comprising means for varying the position of at least one of the side edges of the outlet, the varying means comprising an assembly connected to the applicator surface and having portions positionable to cover at least one of the sides of the outlet.

12. The applicator of claim 10 for a surface having two outside corners, wherein the guiding means comprise a pair of stub guides laterally spaced from each other and connected to the applicator surface, the stub guides being adjustable to vary the lateral distance between the stub guides, so that when the two outside corners are laterally spaced by a distance less than or equal to the spacing of the stub guides, the edges of the surface are engageable by the stub guides.

13. The applicator of claim 12, wherein the outlet has elongated edges extending between the side edges substantially across the width of the housing, the stub guides being mounted to the applicator surface and slideable transversely to the elongated edges of the mastic outlet, the stub guides being slideable between a first position away from and not obstructing the outlet and a second position to cover and obstruct a portion of the outlet.

14. The applicator of claim 13, wherein the applicator surface includes contact points defining contact when the applicator surface is against the dry wall surface that is to receive mastic, a flat base plate mounted on said housing adjacent said applicator surface, wherein the stub guides are mounted on said flat base plate to form a stub guide assembly, the stub guide assembly having stub skids disposed thereon, wherein the first position of the stub guides locates the stub guide assembly to make contact with the dry wall surface that is to receive the mastic, whereby the stub guide assembly does not affect application of mastic to the surface to receive mastic, and wherein the second position of the stub guides locates the stub skids in a position for making contact with said corner surface.

15. The applicator of claim 10 comprising at least one roller at the lower edge of the applicator surface.

16. The applicator of claim 15 comprising a pair of laterally spaced rollers toggle mounted to the applicator surface.

17. An apparatus having a mastic applicator for use with drywall, wallboard or other building surfaces, the mastic applicator comprising:

a housing having an applicator surface;

a mastic outlet located on the applicator surface through which the mastic is applied, the outlet having opposite side edges;

a pair of stub guides displaceably mounted to the applicator surface, the stub guides being laterally spaced from each other, the stub guides being adjustable in relation to each other to vary the distance between the stub guides and having portions positionable to cover the side edges of the outlet; and a pair of stub skids, each one of the stub skids operatively connected to a corresponding one of the stub guides;

wherein the outlet has elongated edges extending between the side edges substantially across the width of the housing, the stub guides being mounted to the applicator surface and slidable transversely to the elongated edges of the mastic outlet, the stub guides being slidable between a first position away from and not obstructing the outlet and a second position to cover and obstruct a portion of the outlet;

wherein the applicator surface includes contact points which contact a dry wall surface when the applicator surface is against the dry wall surface that is to receive mastic, a flat base plate mounted on said housing adjacent said applicator surface, wherein the stub guides are mounted on said flat base plate to form a stub guide assembly, wherein the first position of the stub guides locates the stub guide assembly above contact with the dry wall surface that is to receive the mastic, whereby the stub guide assembly does not affect application of mastic to the surface to receive mastic, and wherein the second position of the stub guides locates the stub skids in a position to engage an outside corner of said dry wall, whereby the contact points include the stub skids when the stub guides are in the second position.

* * * * *